US009856664B1

(12) United States Patent
Parrott

(10) Patent No.: US 9,856,664 B1
(45) Date of Patent: Jan. 2, 2018

(54) WALL PROTECTION SUPPORTS

(71) Applicant: Anthony Edward Parrott, Huntersville, NC (US)

(72) Inventor: Anthony Edward Parrott, Huntersville, NC (US)

( * ) Notice: Subject to any disclaimer, the term of this patent is extended or adjusted under 35 U.S.C. 154(b) by 0 days.

(21) Appl. No.: 15/351,804

(22) Filed: Nov. 15, 2016

(51) Int. Cl.
*E04G 21/30* (2006.01)
*F16M 13/02* (2006.01)

(52) U.S. Cl.
CPC ..... *E04G 21/30* (2013.01); *F16M 13/02* (2013.01); *Y10S 52/12* (2013.01)

(58) Field of Classification Search
CPC ..... F16B 5/00; F16M 13/02; E04G 21/30; E04G 21/24; E04G 21/242; E04G 21/243; Y10S 52/12
See application file for complete search history.

(56) References Cited

U.S. PATENT DOCUMENTS 4,014,435 A * 3/1977 Rowley ..... B65D 85/48 206/386
6,122,887 A * 9/2000 Massett ..... E02D 31/02 52/169.11
6,238,766 B1 * 5/2001 Massett ..... E02D 31/02 405/270
9,365,385 B2 * 6/2016 Muxlow ..... B65H 45/12
2004/0111979 A1 * 6/2004 Koehler, Jr. ..... E04G 21/30 52/23
2005/0047865 A1 * 3/2005 Christensen ..... E01F 9/70 404/72

* cited by examiner

*Primary Examiner* — Andrew J Triggs
(74) *Attorney, Agent, or Firm* — Tillman Wright, PLLC; Jeremy C. Doerre; Chad D. Tillman

(57) ABSTRACT

A system includes one or more wall coverings positioned against a wall, and a plurality of supports spaced generally evenly along the wall holding the one or more wall coverings in place. Each support of the plurality of supports includes an elongate, thin metal plate that is bent at an angle slightly greater than ninety degrees to delineate a base portion engaging a floor, and a back support portion engaging the wall and holding at least one of the one or more wall coverings in place. The back support portion includes a bumper secured to a back side of the back support portion proximate an upper end of the back support portion.

10 Claims, 8 Drawing Sheets

Prior Art

Prior Art

10

WALL PROTECTION SUPPORTS

INCORPORATION BY REFERENCE

The present application hereby incorporates herein by reference the entire disclosure of Appendix A attached hereto.

COPYRIGHT STATEMENT

All of the material in this patent document is subject to copyright protection under the copyright laws of the United States and other countries. The copyright owner has no objection to the facsimile reproduction by anyone of the patent document or the patent disclosure, as it appears in official governmental records but, otherwise, all other copyright rights whatsoever are reserved.

BACKGROUND OF THE INVENTION

The present invention generally relates to wall protection in a construction context.

In the interior upfit construction industry, it is often imperative that existing finishes and materials be protected during the construction process. For example, floors, walls, doors, frames, glass, and millwork that are to remain must generally all be protected, as any damage would incur cost to repair or replace which would frequently come from the bottom line.

Conventionally, a wall is often protected utilizing wall board or rolled corrugated cardboard which is used to line the wall and then held in place with tape. FIGS. 1A-1B illustrate an exemplary such process where rolled corrugated cardboard 04 is positioned against a wall 02 and then secured in place with tape 06.

One problem that arises, however, is that types of tape that will hold a wall covering in place for any length of time will damage the wall surface (e.g. when being removed), while types of tape that won't damage the wall surface will not hold the wall covering in place for very long. Conventionally, it is very common on a project of any but the shortest durations to have to perform repeated maintenance of taped wall coverings, e.g. monitoring and re-taping. This can add to labor and material costs on a daily basis.

A need exists for improvement in wall protection. This, and other needs, are addressed by one or more aspects of the present invention.

SUMMARY OF THE INVENTION

The present invention includes many aspects and features. Moreover, while many aspects and features relate to, and are described in, a particular context, the present invention is not limited to use only in that context, as will become apparent from the following summaries and detailed descriptions of aspects, features, and one or more embodiments of the present invention.

Accordingly, one aspect of the present invention relates to a system comprising one or more wall coverings positioned against a wall; a plurality of supports spaced generally evenly along the wall holding the one or more wall coverings in place, each support of the plurality of supports comprising an elongate, thin metal plate that is bent at an angle slightly greater than ninety degrees to delineate a base portion engaging a floor, and a back support portion engaging the wall and holding at least one of the one or more wall coverings in place, the back support portion comprising a bumper secured to a back side of the back support portion proximate an upper end of the back support portion.

In a feature of this aspect, for each support, the metal plate comprises a steel plate.

In a feature of this aspect, for each support, the metal plate comprises a one eighth inch thick steel plate.

In a feature of this aspect, the one or more wall coverings comprise a corrugated cardboard wall covering.

In a feature of this aspect, the base portion of each support is twelve inches long.

In a feature of this aspect, the back support portion of each support is forty eight inches long.

In a feature of this aspect, the back support portion of each support is ninety six inches long.

In a feature of this aspect, the bumper of each support comprises a rubber bumper.

In a feature of this aspect, the bumper of each support comprises a one eighth inch thick rubber bumper.

In a feature of this aspect, for each support, the elongate, thin metal plate is bent at an angle of ninety five degrees.

Another aspect relates to a method comprising providing a stacked plurality of supports, each support comprising an elongate, thin metal plate that is bent at an angle slightly greater than ninety degrees to delineate a base portion configured for engaging a floor, and a back support portion configured for engaging a wall and holding a wall covering in place, the back support portion comprising a bumper secured to a back side of the back support portion proximate an upper end of the back support portion; positioning one or more wall coverings against a first wall; unstacking the stacked plurality of supports, and positioning the unstacked supports spaced generally evenly along the first wall holding the one or more wall coverings in place, each support being positioned such that its base portion engages a floor, and its back support portion engages the wall and holds at least one of the one or more wall coverings in place.

Another aspect relates to a method of constructing a wall protection support.

Another aspect relates to a method of storing wall protection supports by stacking them.

Another aspect relates to a method of transporting wall protection supports by stacking them.

Another aspect relates to a method of utilizing a wall protection support.

Another aspect relates to a wall protection support.

In addition to the aforementioned aspects and features of the present invention, it should be noted that the present invention further encompasses the various possible combinations and subcombinations of such aspects and features. Thus, for example, any aspect may be combined with an aforementioned feature in accordance with the present invention without requiring any other aspect or feature.

BRIEF DESCRIPTION OF THE DRAWINGS

One or more preferred embodiments of the present invention now will be described in detail with reference to the accompanying drawings, wherein the same elements are referred to with the same reference numerals, and wherein.

DETAILED DESCRIPTION

Figure 1A:
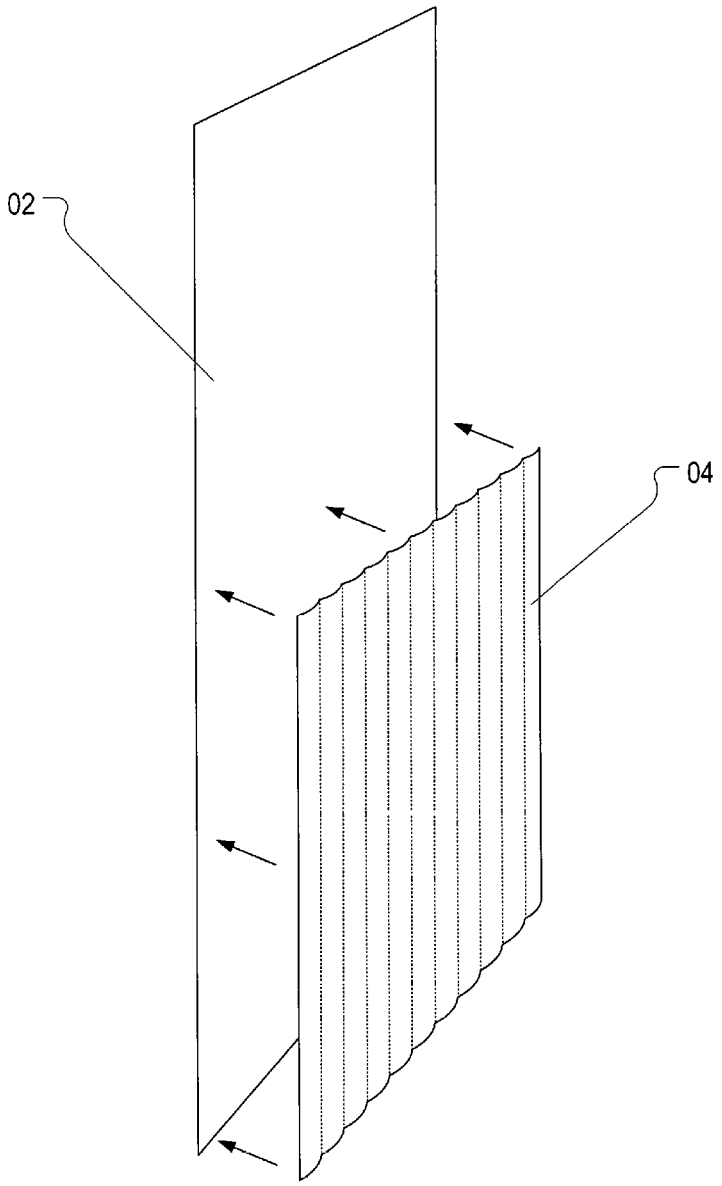
FIGS. 1A-1B illustrate a conventional prior art methodology of securing a wall covering to a wall utilizing tape.

As a preliminary matter, it will readily be understood by one having ordinary skill in the relevant art ("Ordinary Artisan") that the present invention has broad utility and application. As should be understood, any embodiment may incorporate only one or a plurality of the above-disclosed aspects of the invention and may further incorporate only one or a plurality of the above-disclosed features. Furthermore, any embodiment discussed and identified as being "preferred" is considered to be part of a best mode contemplated for carrying out the present invention. Other embodiments also may be discussed for additional illustrative purposes in providing a full and enabling disclosure of the present invention. As should be understood, any embodiment may incorporate only one or a plurality of the above-disclosed aspects of the invention and may further incorporate only one or a plurality of the above-disclosed features. Moreover, many embodiments, such as adaptations, variations, modifications, and equivalent arrangements, will be implicitly disclosed by the embodiments described herein and fall within the scope of the present invention.

Accordingly, while the present invention is described herein in detail in relation to one or more embodiments, it is to be understood that this disclosure is illustrative and exemplary of the present invention, and is made merely for the purposes of providing a full and enabling disclosure of the present invention. The detailed disclosure herein of one or more embodiments is not intended, nor is to be construed, to limit the scope of patent protection afforded the present invention, which scope is to be defined by the claims and the equivalents thereof. It is not intended that the scope of patent protection afforded the present invention be defined by reading into any claim a limitation found herein that does not explicitly appear in the claim itself.

Thus, for example, any sequence(s) and/or temporal order of steps of various processes or methods that are described herein are illustrative and not restrictive. Accordingly, it should be understood that, although steps of various processes or methods may be shown and described as being in a sequence or temporal order, the steps of any such processes or methods are not limited to being carried out in any particular sequence or order, absent an indication otherwise. Indeed, the steps in such processes or methods generally may be carried out in various different sequences and orders while still falling within the scope of the present invention. Accordingly, it is intended that the scope of patent protection afforded the present invention is to be defined by the appended claims rather than the description set forth herein.

Additionally, it is important to note that each term used herein refers to that which the Ordinary Artisan would understand such term to mean based on the contextual use of such term herein. To the extent that the meaning of a term used herein—as understood by the Ordinary Artisan based on the contextual use of such term—differs in any way from any particular dictionary definition of such term, it is intended that the meaning of the term as understood by the Ordinary Artisan should prevail.

Regarding applicability of 35 U.S.C. §112, ¶6, no claim element is intended to be read in accordance with this statutory provision unless the explicit phrase "means for" or "step for" is actually used in such claim element, whereupon this statutory provision is intended to apply in the interpretation of such claim element.

Furthermore, it is important to note that, as used herein, "a" and "an" each generally denotes "at least one," but does not exclude a plurality unless the contextual use dictates otherwise. Thus, reference to "a picnic basket having an apple" describes "a picnic basket having at least one apple" as well as "a picnic basket having apples." In contrast, reference to "a picnic basket having a single apple" describes "a picnic basket having only one apple."

When used herein to join a list of items, "or" denotes "at least one of the items," but does not exclude a plurality of items of the list. Thus, reference to "a picnic basket having cheese or crackers" describes "a picnic basket having cheese without crackers", "a picnic basket having crackers without cheese", and "a picnic basket having both cheese and crackers." Finally, when used herein to join a list of items, "and" denotes "all of the items of the list." Thus, reference to "a picnic basket having cheese and crackers" describes "a picnic basket having cheese, wherein the picnic basket further has crackers," as well as describes "a picnic basket having crackers, wherein the picnic basket further has cheese."

Referring now to the drawings, one or more preferred embodiments of the present invention are next described. The following description of one or more preferred embodiments is merely exemplary in nature and is in no way intended to limit the invention, its implementations, or uses.

Figure 1B:
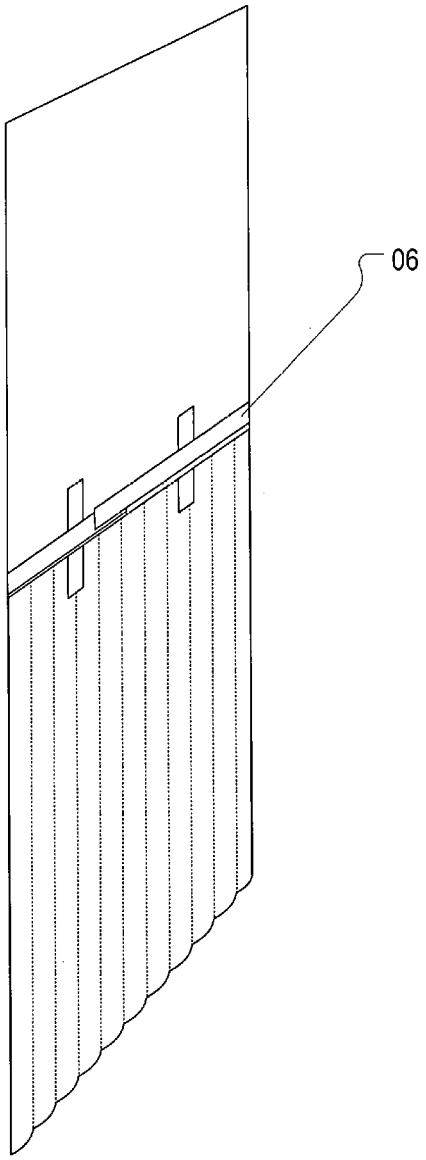

As described hereinabove, in the interior upfit construction industry, conventionally, a wall is often protected by placing a wall covering against a wall and taping it in place, as illustrated in FIGS. 1A-1B.

Figure 2:
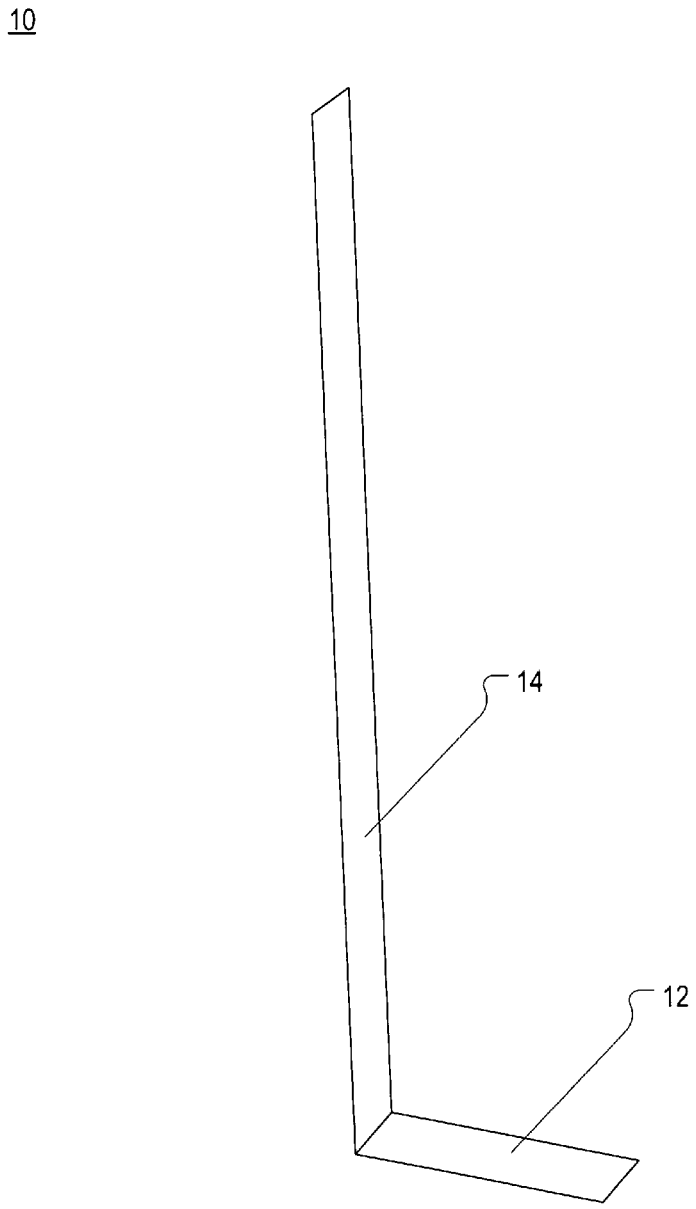
FIGS. 2-4 illustrate a wall protection support in accordance with one or more preferred implementations.
Figure 3:
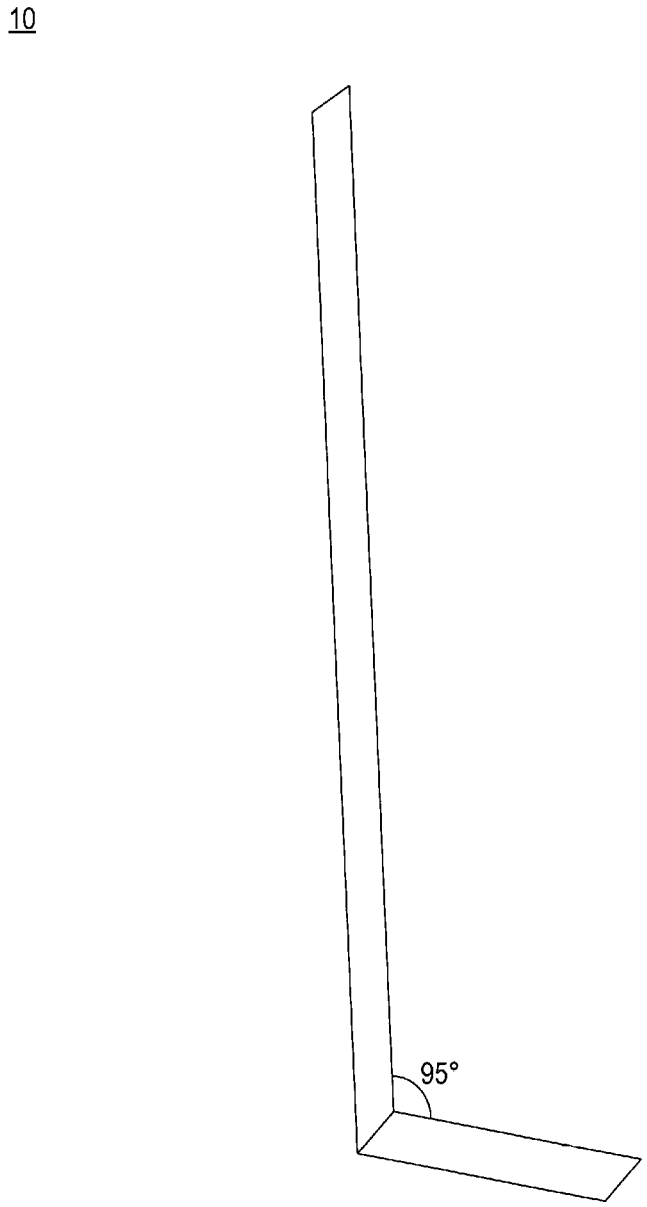
Figure 4:
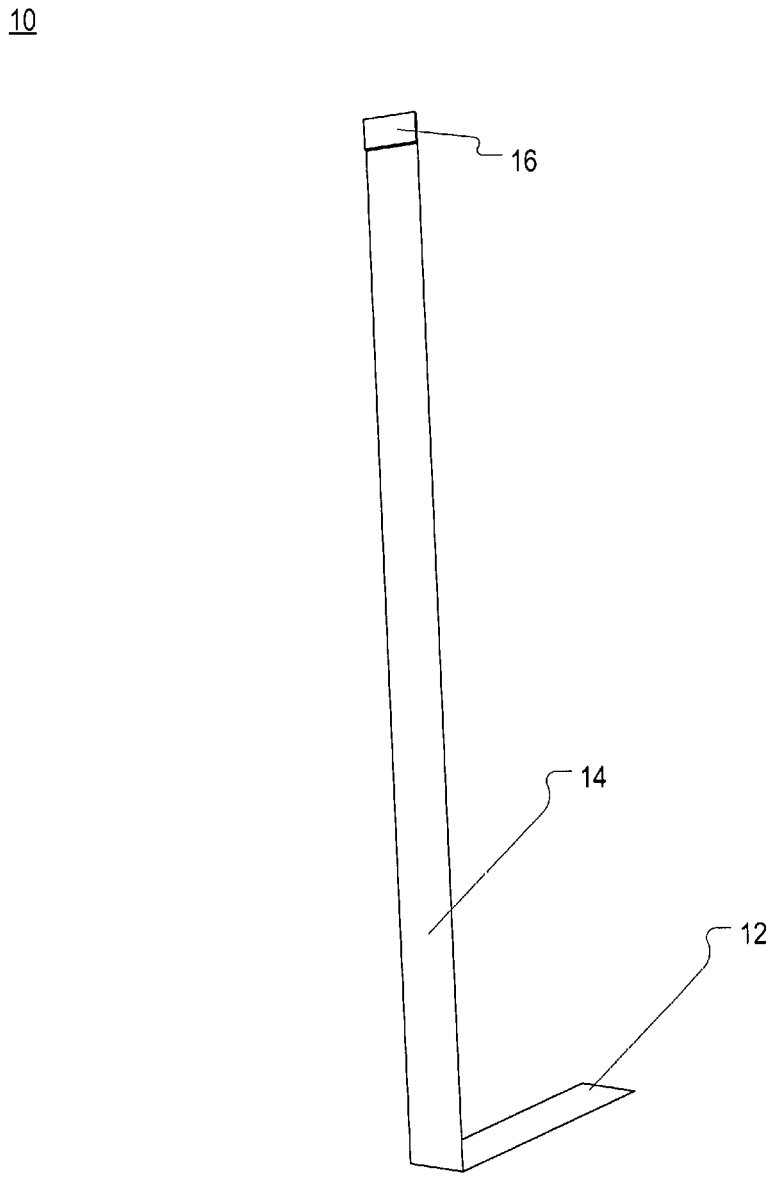

FIG. 2 illustrates a wall protection support 10 in accordance with one or more preferred implementations which can be utilized to hold a wall covering in place against a wall. The support 10 comprises a one eighth inch thick steel plate which has been bent at an angle slightly greater than ninety degrees, e.g. ninety five degrees, as illustrated in FIG. 3, although it will be appreciated that other angles may be utilized, including possibly even ninety degrees in one or more implementations. The support 10 can be characterized as including a base portion 12 and a back support portion 14. The back support portion 14 preferably includes a bumper 16 (e.g. a one eighth inch thick rubber bumper) secured to a back side of the back support portion 14 proximate a top of the back support portion 14, as illustrated in FIG. 4.

Figure 5:
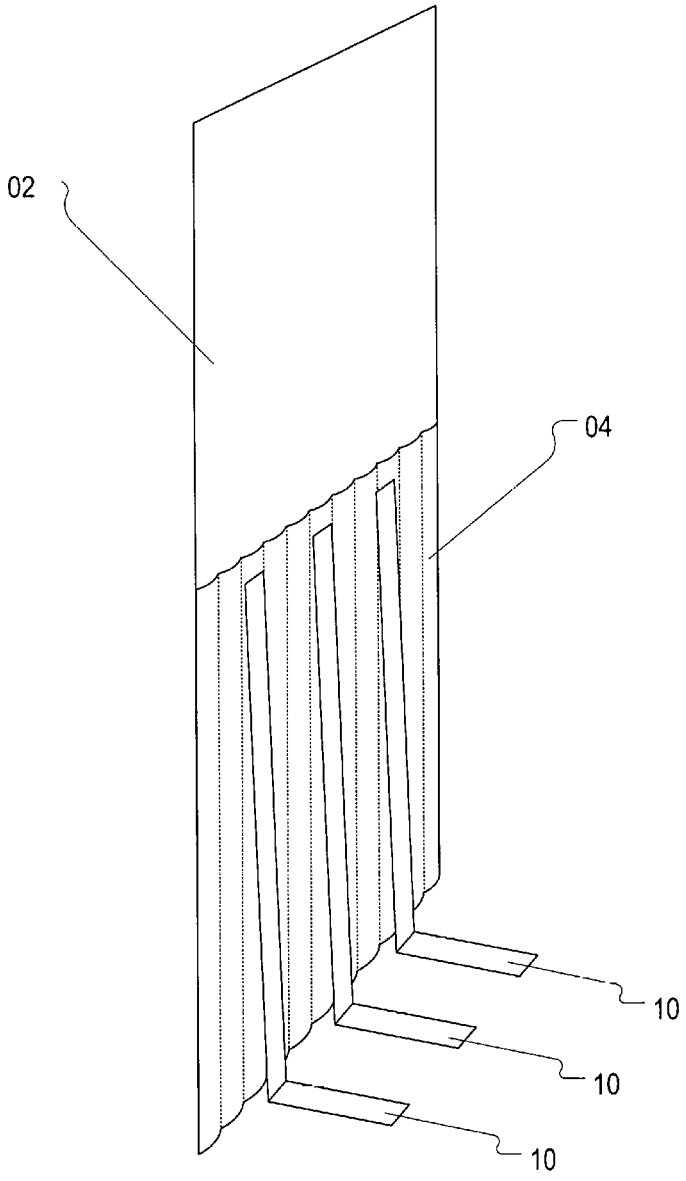
FIG. 5 illustrates use of a plurality of wall protection supports to support a wall covering for a wall.

The support 10 is configured to allow it to be used to hold a wall covering 04 in place against a wall 02, as illustrated in FIG. 5. In accordance with one or more preferred implementations, the greater than ninety degree angle of the support 10 allows it to provide positive pressure to a wall surface when placed against a wall. In accordance with one or more preferred implementations, a support 10 may be positioned with its base portion 12 and the bottom of its back support portion 14 pushed all the way in and flush against a wall, while in one or more preferred implementations a support 10 may be positioned with its base portion 12 spaced slightly out from a wall, as illustrated in FIG. 5.

In one or more preferred methodologies of use, a plurality of supports 10 are positioned spaced out along a wall 02 (e.g. at generally regular intervals) to support a wall covering 04, as illustrated in FIG. 5. Although not illustrated, in accordance with one or more preferred implementations, one or more floor coverings are utilized as well, and the base portions 12 of the supports 10 are positioned on top of a floor covering and/or below a floor covering. In accordance with one or more preferred implementations, one or more supports 10 are painted to match a wall, floor, floor covering, and/or wall covering. The supports can be painted either before or after being positioned to support a covering.

Figure 6:
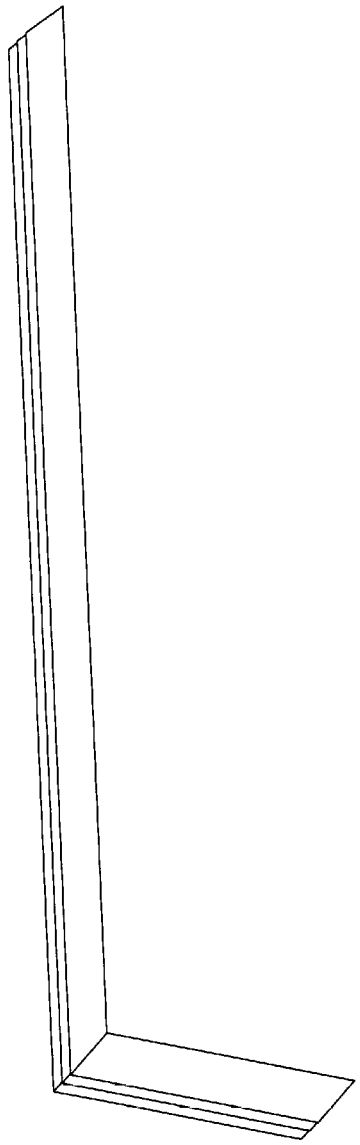
FIG. 6 illustrates stacking of a plurality of wall protection supports.

In accordance with one or more preferred implementations, supports 10 are configured to be stackable for transportation and storage, as illustrated in FIG. 6. In one or more preferred methodologies of use, a plurality of supports 10 are stored and/or transported in a stacked configuration, and then utilized to support one or more wall coverings during a construction project, before then being restacked for storage and/or transportation.

Figure 7:
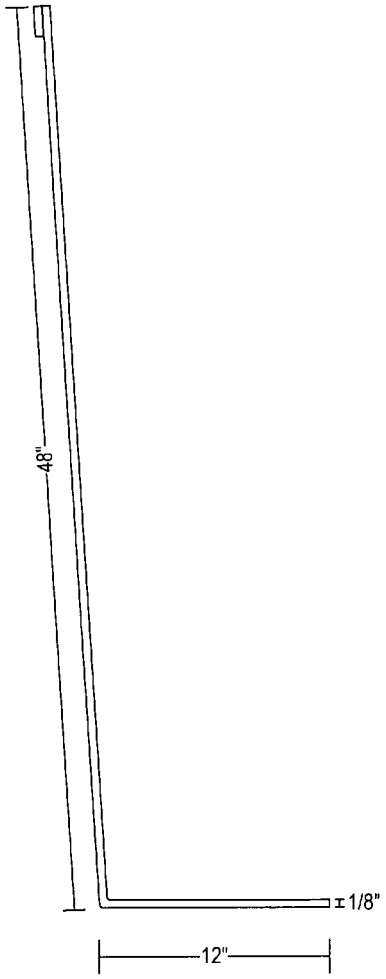
FIG. 7 illustrates dimensions of an exemplary wall protection support in accordance with one or more preferred implementations.

FIG. 7 illustrates dimensions of the exemplary wall protection support 10 in accordance with one or more preferred implementations. The base portion 12 of the wall protection support 10 is twelve inches long, and the back support portion 14 is forty eight inches long. In accordance with one or more preferred implementations, the wall protection support 10 is two inches wide.

It will be appreciated, however, that these dimensions may be varied. For example, in accordance with one or more preferred implementations, the back support portion 14 may be ninety six inches long. In accordance with one or more preferred implementations with such a longer back support portion 14, the wall protection support is four inches wide.

In accordance with one or more preferred implementation, a wall protection support is sized and dimensioned to accommodate standard materials. In accordance with one or more preferred implementations, a base portion is configured to have a length sufficient to provide adequate support (e.g. under floor protection).

In accordance with one or more preferred implementations, a wall protection support apparatus is constructed by bending a steel plate and then attaching a bumper thereto.

Although wall protection supports comprising a steel plate and rubber bumper are described herein, other materials can be utilized in one or more preferred implementations. In accordance with one or more preferred implementations, a wall protection support is constructed out of extruded plastic.

Based on the foregoing description, it will be readily understood by those persons skilled in the art that the present invention is susceptible of broad utility and application. Many embodiments and adaptations of the present invention other than those specifically described herein, as well as many variations, modifications, and equivalent arrangements, will be apparent from or reasonably suggested by the present invention and the foregoing descriptions thereof, without departing from the substance or scope of the present invention. Accordingly, while the present invention has been described herein in detail in relation to one or more preferred embodiments, it is to be understood that this disclosure is only illustrative and exemplary of the present invention and is made merely for the purpose of providing a full and enabling disclosure of the invention. The foregoing disclosure is not intended to be construed to limit the present invention or otherwise exclude any such other embodiments, adaptations, variations, modifications or equivalent arrangements, the present invention being limited only by the claims appended hereto and the equivalents thereof.

What is claimed is:

1. A method comprising:

(a) providing a stacked plurality of supports, each support comprising (i) an elongate, thin metal plate that is bent at an angle slightly greater than ninety degrees to delineate (A) a base portion configured for engaging a floor, and (B) a back support portion configured for engaging a wall and holding a wall covering in place, the back support portion comprising a bumper secured to a back side of the back support portion proximate an upper end of the back support portion;

(b) positioning one or more wall coverings against a first wall;

(c) unstacking the stacked plurality of supports, and positioning the unstacked supports spaced generally evenly along the first wall holding the one or more wall coverings in place, each support being positioned such that (i) the base portion engages a floor, and (ii) the back support portion engages the wall and holds at least one of the one or more wall coverings in place.

2. The method of claim 1, wherein, for each support, the metal plate comprises a steel plate.

3. The method of claim 1, wherein, for each support, the metal plate comprises a one eighth inch thick steel plate.

4. The method of claim 1, wherein the one or more wall coverings comprise a corrugated cardboard wall covering.

5. The method of claim 1, wherein the base portion of each support is twelve inches long.

6. The method of claim 1, wherein the back support portion of each support is forty eight inches long.

7. The method of claim 1, wherein the back support portion of each support is ninety six inches long.

8. The method of claim 1, wherein the bumper of each support comprises a rubber bumper.

9. The method of claim 1, wherein the bumper of each support comprises a one eighth inch thick rubber bumper.

10. The method of claim 1, wherein, for each support, the elongate, thin metal plate is bent at an angle of ninety five degrees.

* * * * *